US006216467B1

(12) United States Patent
O'Neil et al.

(10) Patent No.: US 6,216,467 B1
(45) Date of Patent: Apr. 17, 2001

(54) CRYOGENIC REFRIGERATOR WITH A GASEOUS CONTAMINANT REMOVAL SYSTEM

(75) Inventors: James A. O'Neil, Bedford; Ronald N. Morris, N. Falmouth; Gordon C. Cheng, Carlisle, all of MA (US)

(73) Assignee: Helix Technology Corporation, Mansfield, MA (US)

( * ) Notice: Subject to any disclaimer, the term of this patent is extended or adjusted under 35 U.S.C. 154(b) by 0 days.

(21) Appl. No.: 09/187,380

(22) Filed: Nov. 6, 1998

(51) Int. Cl.[7] ..... F25B 9/00

(52) U.S. Cl. ..... 62/6

(58) Field of Search ..... 62/6, 908

(56) References Cited

U.S. PATENT DOCUMENTS

| | | | | |
|---|---|---|---|---|
| 3,262,277 | | 7/1966 | Nesbitt | 62/6 |
| 3,315,490 | | 4/1967 | Berry et al. | 62/333 |
| 3,678,992 | | 7/1972 | Daniels | 165/10 |
| 3,793,846 | | 2/1974 | Dehne | 62/6 |
| 4,192,661 | | 3/1980 | Johnson | 62/12 |
| 4,404,808 | | 9/1983 | Andeen | 62/6 |
| 4,425,764 | * | 1/1984 | Lam | 62/6 |
| 4,475,346 | | 10/1984 | Young et al. | 62/6 |
| 4,835,973 | | 6/1989 | Jones et al. | 62/6 |
| 5,339,639 | | 8/1994 | Garrett | 62/6 |
| 5,617,727 | | 4/1997 | Zito | 62/55.5 |

FOREIGN PATENT DOCUMENTS

| | | |
|---|---|---|
| 31 20 233 A1 | 12/1982 | (DE) . |
| 2 219 384 | 12/1989 | (GB) . |
| 04036552 | 2/1992 | (JP) . |

OTHER PUBLICATIONS

V.G. Pron'ko et al., "Some Problems of Using Adsorbents as a Matrix Material for Low–Temperature Regenerators of Cryogenic Refrigerators," Sixth International Cryogenic Engineering Conf., 86–88 (1976).

H.J. Halkama et al., "Measurements of adsorption isotherms and pumping speed of helium on molecular sieve in the $10^{-11}$ –$10^{-7}$ Torr range at 4.2 K*, " *J. Vac. Sci. Technol.*, 11(1) :333–336 (1974).

W.V. Dingenen et al., "Measurements on the Adsorption of Light and Heavy Hydrogen on Charcoal Between 90°K and 17°K," Physica, 6(1) :49–58 (1939).

J.P. Hobson, "Physical Adsorption Isotherms Extending from Ultrahigh Vacuum to Vapor Pressure," Phys. Chem., 73 (8) :2720–2727 (1969).

G.E. Grenier et al., "Crysorption Pumping of Helium at 4.2°K," *J. Vac. Sci. Technol.*, 3(6) :334–337 (1966).

S.A. Stern et al., "The Adsorption of Atmospheric Gases on Molecular Sieves at Low Pressure and Temperatures. The Effect of Preadsorbed Water," *J. Vac. Sci. Technol.*, 4(6) :347–355 (1967).

(List continued on next page.)

*Primary Examiner*—Corrine McDermott
*Assistant Examiner*—Malik N. Drake
(74) *Attorney, Agent, or Firm*—Hamilton, Brook, Smith & Reynolds, P.C.

(57) ABSTRACT

A cryogenic refrigerator includes a shell having a reciprocative displacer and an adsorbent mounted within the shell. In one embodiment, the displacer contains both a regenerative media and the adsorbent, with the regenerative media placed between the adsorbent and a cold end of the displacer. In a method for removing contaminants from the reciprocative displacer, compressed and expanded helium gas is displaced through the displacer, with the adsorbent positioned to adsorb contaminant gases entrained in the helium gas. In another method, a filtering refrigerator containing an adsorbent is coupled to a helium circuit of a refrigeration system to remove contaminants from the circuit.

24 Claims, 3 Drawing Sheets

OTHER PUBLICATIONS

J.P. Hobson, "Theoretical Isotherms for Physical Adsorption at Pressures below $10^{-10}$ Torr," *J. Vac. Sci. Technol.*, 3(5) :281–284 (1966).

R.J. Powers et al., "A Clean Cryo–Vacuum System with High Pumping Speeds for All Gas Species," *J. Vac. Sci. Technol.*, 8(1) :319–323 (1971).

Diagram of Compressor and Joule–Thomson Refrigerator, "Installation, Operation and Servicing Instructions, Recondenser," Helix Technology Corp., at 24, (1989) (pamphlet).

"Operator's Manual Cryodyne (R) Helium Refrigerator Model 400A," consisting of 7 pages (1967).

* cited by examiner

CRYOGENIC REFRIGERATOR WITH A GASEOUS CONTAMINANT REMOVAL SYSTEM

BACKGROUND OF THE INVENTION

Cryogenic refrigerators, such as those incorporated in cryogenic vacuum pumps (cryopumps), commonly are of a "Gifford-McMahon" design. Under standard operation, a two-stage cryogenic refrigerator of this design can typically cool to extremely low temperatures—typically, 4 to 25K.

A refrigerator that performs a Gifford-McMahon cooling cycle is illustrated in FIG. 1. The refrigerator includes a displacer 12 including a first stage 14 and a second stage 16. Both stages of the displacer 12 are filled with regenerative heat-exchange media in the form, for example, of tiny lead balls 18' and/or a bronze or copper screen 18". The displacer 12 reciprocates linearly within a shell 20 under the force of a motor-driven shaft 22. The shell 20 includes a first-stage cylinder 24 and a second-stage cylinder 26 conforming to and coaxial with the displacer 12 while accommodating a range of axial reciprocation of the displacer 12.

Cooling is predicated upon a reversing flow of helium gas through the shell 20 and expansion of the gas. Compressed helium gas is supplied by a compressor through a supply line 28 connected via an inlet valve 30 to the warm end 32 of the first-stage cylinder 24. With the displacer 12 at a cold end 34 of the shell 20 (remote from the inlet 35 of the supply line 28), the inlet valve 30 is opened, allowing the shell 20 to fill with compressed gas. As the compressed helium flows through the shell 20, the displacer 12 is drawn from the cold end 34 to the warm end 32 of the shell 20, forcing helium gas through passages 64, 64', 64", and 64'" of the displacer 12. The helium gas flows through the passages between the regenerative media 18', 18" filling the displacer 12, and the helium gas transfers heat to the regenerative media 18', 18", which have been precooled in previous refrigeration cycles.

When the shell 20 is filled with compressed helium and the displacer 12 is fully withdrawn to the warm end 32 of the shell 20, the inlet valve 30 is closed and the outlet valve 36 leading to a return line 38 connected to the inlet of the compressor is opened. The compressed helium gas thereby flows back through the displacer 12 and out of the shell 20, expanding into the return line 38. The helium cools with expansion, and heat is extracted from heat sinks 40, 42 (e.g., cryopanels in cryopumps) with which the refrigerator is in thermal contact. As the cooled helium flows through the displacer 12, heat is also transferred from the regenerative media (e.g., a bronze or copper screen 18" in the first stage 14 and lead balls 18' in the second stage 16) to the helium gas.

After the pressure has equilibrated between the shell 20 and the return line 38, the outlet valve 36 is closed. With the displacer 12 at the cold end 34 of the shell 20, the inlet valve 30 is reopened and the cycle is repeated.

One application for cryogenic refrigerators is in cryogenic vacuum pumps (cryopumps). Currently available cryopumps generally follow a common design. A low-temperature array, cooled to 4 to 25K (most commonly to 10 to 20K), serves as the second-stage heat sink 42 and the primary pumping surface. This array is surrounded by a higher-temperature radiation shield, usually operated in the temperature range of 40 to 130K. The radiation shield serves as the first-stage heat sink 40 to the refrigerator, and it protects the low-temperature array from radiated heat. The radiation shield generally includes a housing that is closed except at an opening where a frontal array is positioned between the primary pumping surface and a work chamber to be evacuated.

During operation, high-boiling-point gases such as water vapor are condensed on the frontal array. Lower-boiling-point gases pass through that array and into the volume within the radiation shield and condense on the low-temperature array. A surface coated with an adsorbent, such as charcoal or a molecular sieve, operating at or below the temperature of the colder array may also be provided in this volume to remove the very-low-boiling-point gases such as hydrogen. With the gases thus condensed or adsorbed on the pumping surfaces, a vacuum is created in the work chamber. Such a cryogenic refrigerator is described in U.S. Pat. No. 5,775,109, which is hereby incorporated by reference in its entirety.

Plural cryopumps, all fed by a common compressor supplying compressed helium to a common flow circuit, are often incorporated into a cluster tool for processing semiconductor wafers. Within a cluster tool, the vacuum pumps create the vacuums that are needed to perform sensitive processing steps, such as chemical vapor deposition. An embodiment of a representative cluster tool is likewise described in U.S. Pat. No. 5,775,109.

SUMMARY OF THE INVENTION

Though the compressed helium supply for cryogenic refrigerators is often of fairly high purity, some degree of vapor contamination in the helium circuit is typical. While helium will not condense in significant amounts anywhere in the system, common contaminants, such as nitrogen, will often begin to condense in significant quantities at temperatures below 60K. The operation of a cryogenic refrigerator can be improved by reducing the amount of nitrogen and other contaminants that condense within the shell.

As noted, above, the shell of the refrigerator has a temperature profile extending down to 4 to 25K at its cold end. As the temperature drops, the vapor pressure of nitrogen saturation drops. At temperatures where nitrogen has a saturation pressure lower than the partial pressure of nitrogen in the system, nitrogen will condense to lower the partial pressure of nitrogen vapor to the saturation limit at that temperature. As a result, nitrogen will selectively condense toward the cold end of the shell of the refrigerator producing an accumulation of condensed solids that will block the flow of helium gas. This blockage increases the torque needed to drive the displacer and eventually leads to ratcheting, in certain motors, or stalling in the operation of the refrigerator. Besides compromising operating efficiency, ratcheting can be damaging to the refrigerator and may also cause damage to the broader system that depends on the refrigerator for cooling.

Apparatus and methods of this invention remedy this problem with an adsorbent for adsorbing contaminants before they condense. Within a highly-porous adsorbent, such as charcoal, contaminants can safely be adsorbed within pores at temperatures higher than the condensation temperature with reduced risk of blocking the flow of compressed helium gas in the shell.

A cryogenic refrigerator of this invention includes a reciprocative displacer and an adsorbent within a shell. The adsorbent is positioned to adsorb contaminant gases within the shell in accordance with a method of this invention.

In accordance with one aspect of the invention, the adsorbent and a regenerative media are both contained in the displacer, and the regenerative media is positioned on both sides of the adsorbent such that it is both between the displacer cold end and the adsorbent and between the displacer warm end and the adsorbent.

Preferably, the adsorbent has a surface-to-volume ratio greater than 50 $m^2/cm^3$ and a mean pore size not greater than 10 times the molecular size of the adsorbent material.

The adsorbent can include carbon, crystalline aluminosilicate, crystalline aluminophosphate or silica gel. Preferably, the adsorbent is charcoal, and the regenerative media is a metal, such as lead.

The refrigerator is preferably a Gifford-McMahon refrigerator, wherein the shell includes an inlet and outlet for helium gas flow, with both positioned at a warm end of the shell. Further, the displacer preferably includes a first stage and a second stage. The adsorbent is positioned in the first stage, with the second stage positioned remotely from the warm end of the shell. Alternatively, the adsorbent can be positioned outside the displacer, yet still within the shell, at a position where it is in contact with the gas flow and is sufficiently cooled to adsorb contaminants therefrom.

Further still, the adsorbent is preferably at a position where the temperature is between 50K and 150K during normal operation of the refrigerator, and above 40K, exclusively. During normal refrigerator operation, the cold end of the displacer is cooled to a temperature between about 4K and about 25K. Accordingly, in this preferred embodiment, the adsorbent does not extend into the coldest regions of the displacer and shell.

In one embodiment, the adsorbent is positioned in a hollow within the end cap of the first stage. The end cap is traditionally provided to define a gap, in coordination with the inner wall of the shell, through which the cooled helium gas flows after leaving the displacer through a side passage in the first stage. A heat station is provided along the inner wall along this gap to be cooled by the helium gas flowing there through. By installing an adsorbent within the end cap, adsorption can take place without a need either to enlarge the displacer or to take away space from the regenerative media. When viewed along the longitudinal axis of the displacer, the side passage is positioned within a plane normal to the axis, wherein regenerative media is on one side of the plane, toward the warm end of the first-stage cylinder, and the adsorbent is positioned on the other side.

In a preferred embodiment of the method of this invention, compressed helium gas is filtered by passing it across regenerative media within the displacer to cool the compressed gas, then across an adsorbent (distinct from the regenerative media) to adsorb contaminant gases, and then across additional regenerative media within the displacer to further cool the compressed gas. While the adsorbent is cooled to a temperature above about 50K, the additional regenerative media is preferably cooled to a temperature below about 50K. Nearly all of the heat transferred between the helium gas and material within the displacer is with a regenerative media distinct from the adsorbent. I.e., the adsorbent is not a conduit for a significant amount of heat exchange in the refrigerator.

In another method of this invention, a filtering refrigerator removes contaminants from a helium circuit in a cryogenic refrigeration system. The filtering refrigerator contains an adsorbent for adsorbing contaminants entrained in the helium gas. Helium gas in the helium circuit passes through a compressor, supply lines, and at least one system refrigerator. Contaminants are removed from this circuit by coupling a filtering refrigerator into the helium circuit to facilitate flow of helium gas through the filtering refrigerator. Helium gas is circulated through the helium circuit, and the filtering refrigerator is operated to cool the adsorbent contained therein, thereby causing contaminants in the gas stream to condense on the cooled adsorbent. Finally, the filtering refrigerator, along with the adsorbent and the absorbed contaminants, is isolated from the helium circuit.

The filtering refrigerator can be a single-stage refrigerator. Preferably, the filtering refrigerator is cooled before the other refrigerators to adsorb contaminants, and the system refrigerator(s) commence(s) operation after the filtering refrigerator has been operated to adsorb contaminants entrained in the helium gas.

Advantages of this invention include the provision of compact and efficient means for removing contaminants within a cryogenic refrigerator. By adsorbing contaminants onto an adsorbent, rather than allowing contaminants to condense at or near a cold end of a displacer, the method of this invention reduces clogging of gas flow and the accompanying risk of ratcheting in the refrigerator. Further, with reduced contaminant condensation, the regenerative media transfer heat more efficiently. Finally, because the adsorbent is positioned within the shell, the adsorbent can be cooled to a temperature appropriate for efficient adsorption, while requiring only marginal modification of a conventional refrigeration system to provide the necessary structure and cooling to adsorb contaminants.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

The features and other details of the method of the invention will now be more particularly described with reference to the accompanying drawings and pointed out in the claims. Numbers that appear in more than one figure represent the same item. It will be understood that the particular embodiments of the invention are shown by way of illustration and not as limitations of the invention. The principal features of this invention can be employed in various embodiments without departing from the scope of the invention.

Figure 2:
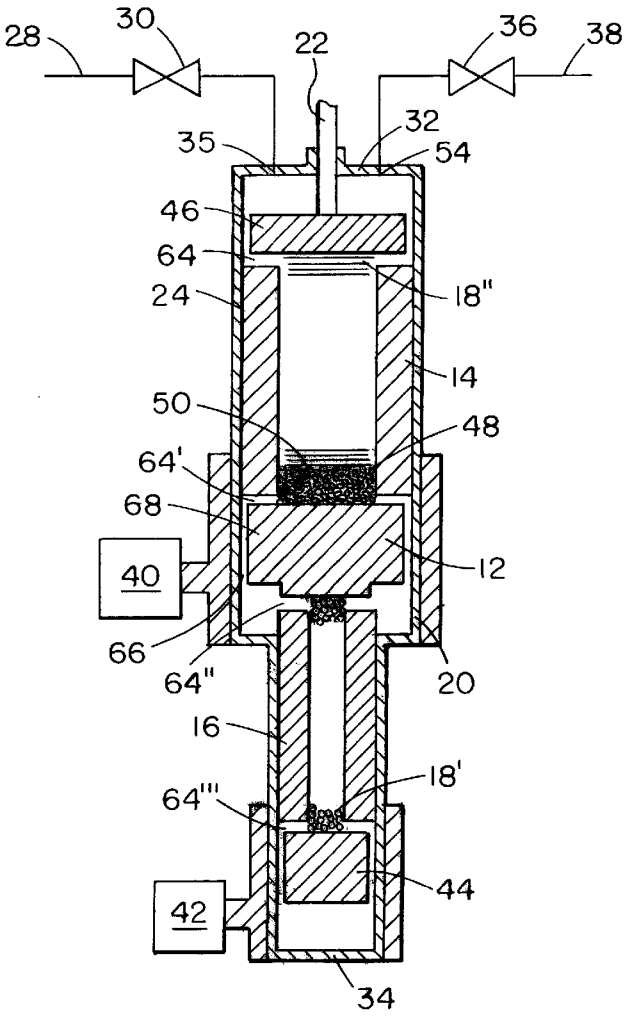
FIG. 2 is an illustration partially schematic, of a cross-section of a cryogenic refrigerator of this invention, which includes an adsorbent within the displacer.
Figure 1:
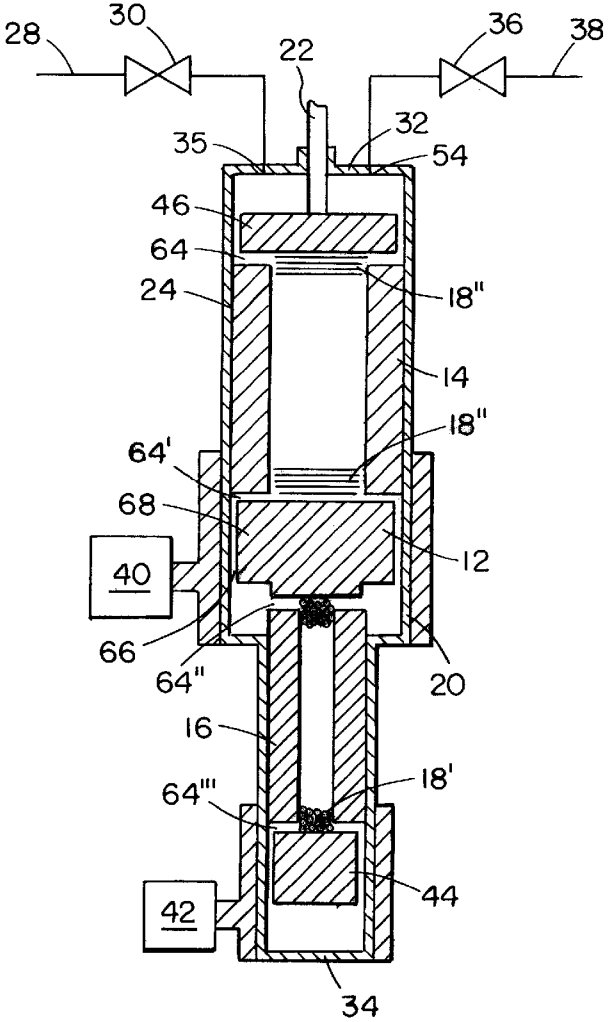
FIG. 1 PRIOR ART
FIG. 1 is an illustration, partially schematic, of a cross-section of a conventional Gifford-McMahon cryogenic refrigerator. For ease of illustration in both this drawing and the following drawing, less than all of the regenerative media that fill the displacer are shown.

A cryogenic refrigerator of this invention is illustrated in FIG. 2. As in the conventional refrigerator illustrated in FIG. 1, the refrigerator includes a two-stage displacer 12 mounted within a shell 20. During normal operation of the refrigerator after cooldown, a temperature profile across the displacer 12 is established, wherein the cold end 44 of the two-stage displacer 12 has a temperature between about 4K and about 25K. The precise temperature to which the cold end 44 is cooled is determined by the needs of the system for which it provides cooling. For example, in a cryogenic vacuum pump, a low-temperature cryopanel serves as a heat sink 42 for the cold end, and the temperature of the cryopanel and the cold end 44 approach equilibrium during operation. In this case, the desired cooling temperature is determined by the composition of the vapors being condensed and the level of vacuum desired. When a heat station is attached, the temperature at a heat sink 40 on the first-stage cylinder 24 of a two-stage refrigerator is typically about 50K, while the temperature at a warm end 32 of the first stage cylinder 24 is near ambient temperature (i.e., about 300K).

Within the shell 20, the displacer 12 reciprocates along the same axis as the shaft 22 which drives it. The first stage 14 of the displacer 12 contains bronze or copper screens 18", while the second stage 16 contains tiny lead balls 18', with both the screens 18" and the balls 18' serving as regenerative heat-exchange media. Unique to this invention, the displacer 12 also contains an adsorbent 48 positioned to adsorb contaminants from the helium gas before the contaminants condense at cooler temperatures. The adsorbent 48 is a material of high porosity with a very large surface area (preferably, greater than 50 $m^2/cm^3$) to which contaminant gas molecules can be bound. In this embodiment, the adsorbent 48 is contained in the first stage 14 of the displacer 12 and is in the form of activated charcoal particles having a size of 8 to 16 mesh, an average pore size of 22 Angstroms, and a surface area of 500 $m^2/cm^3$. Approximately 3–10 g of charcoal is provided, enclosed in a mesh 50 of stainless steel or bronze. Alternatively, the adsorbent 48 can be silica gel or a molecular sieve made of a crystalline aluminosilicate or crystalline aluminophosphate.

Ideally, the adsorbent 48 is placed in a region of the displacer 12 that is warmer than where a contaminant would condense in the displacer 12 yet cold enough to maximize the ability of the adsorbent 48 to hold the contaminant gas. The contaminant that is typically of primary concern is nitrogen ($N_2$). As a dominant component of ambient atmosphere, nitrogen often leaks into the system in significant quantities. An appropriate lower-temperature limit for placement of the adsorbent 48 can accordingly be determined by examining the condensation temperatures for contaminant concentrations that are of concern. In a system with a nitrogen concentration of 1100 ppm, nitrogen will begin to condense at approximately 52K. Accordingly, condensation of nitrogen at this contamination level can be alleviated by placing the adsorbent at 55K, for example. If contaminant concentration levels are expected to be lower than 1100 ppm, the adsorbent can be moved to a lower temperature, such as 50K, to prevent condensation. On the other hand, if the presence of nitrogen at higher partial pressures is an issue, the adsorbent 48 should be moved to a warmer temperature. For example, nitrogen present in a concentration of 4400 ppm will begin to condense at approximately 60K, meaning that the adsorbent 48 should be placed at a temperature greater than 60K.

While the adsorbent should be positioned where its temperature will be higher than the condensation temperature of the contaminant, the adsorbent should not be placed too far above that temperature because its efficiency as an adsorbent decreases with increasing temperature. For example, nitrogen, present in a concentration of 1100 ppm, will begin to condense at 52K. In this example, an adsorbent placed at 60K will absorb far more nitrogen than an adsorbent placed at 100K and will therefore be more effective in preventing condensation at lower temperatures downstream. Where adsorbent displaces the conventional regenerative material, placing adsorbent in unnecessarily high and low temperature regions reduces the regenerative capacity without substantially improving decontamination. In view of these considerations, the optimum position for the adsorbent will typically be only where its temperature will be between about 50K and about 150K.

The use of adsorbent materials in a displacer, as described, above, is readily distinguished from other, known uses of adsorbents in displacers. Known uses of adsorbents within a displacer are directed toward ultra-low temperatures, i.e., below about 12K, where the adsorbent is used to adsorb the working fluid, i.e., helium. At temperatures below about 12K, lead media loses its efficiency as a regenerator, and an adsorbed-helium/carbon matrix was thought to be a more effective medium for storing heat due to its higher heat capacity at these temperatures. However, at warmer temperatures, such as those at which the adsorbent is employed in the present invention, traditional regenerative media, such as lead, offer regenerative performance far superior to that of carbon adsorbent. Accordingly, and in contrast to the present invention, use of the adsorbent in previously known applications is limited solely to the coldest region of the displacer. In contrast, charcoal used in accordance with this invention is positioned in a region with temperatures above those at which the charcoal would function effectively as a regenerative medium.

Basic operation of a refrigerator of this invention commences when an inlet valve 30 is opened, opening a flow of compressed helium from the compressor into the shell 20. The displacer 12 is then drawn from the shell's cold end 34 toward its warm end 32 where the helium inlet 52 and outlet 54 are located. The displacer 12 displaces the incoming helium gas toward the cold end 34 of the shell 20 as the displacer 12 is drawn toward the warm end 32. The compressed helium gas is cooled as it flows through the displacer 12 and across the regenerative media 18', 18".

Passages 64, 64', 64" and 64'" allow for gas flow in and out of the displacer 12 and are positioned along the sides of the displacer 12. As helium flows through the passage 64' near the cold end of the first stage 14, the helium is forced through a thin gap 66 between the displacer 12 and the shell 20, where the helium is forced into close contact with the first-stage heat sink 40 for efficient heat exchange between the helium and the heat sink 40. To provide a sufficient length of passage through the gap 66, end caps 68 are provided in conventional displacers. The end cap 68 typically extends from the passage 64' to the warmer end of the second stage 16.

Though helium will neither condense nor adsorb to any noticeable extent at temperatures greater than about 40K, contaminant gases entrained in the nitrogen can be removed at warmer temperatures. The condensation temperature for nitrogen over a range of vapor partial pressures is discussed, above. Assuming a contaminant-nitrogen concentration of 1100 ppm, where nitrogen will condense at approximately 52K, much of the nitrogen can be adsorbed and effectively removed from the system at 60K. As the temperature of the adsorbent 48 is increased, the amount of nitrogen that can be adsorbed thereon will gradually decrease.

After the shell 20 has filled with compressed helium, the inlet valve 30 is closed and the displacer 12 is brought to rest against the warm end 32 of the shell 20. The outlet valve 36 is then opened and the compressed helium expands into the return line 38, cooling as it expands. The now-cooler helium gas extracts heat from the regenerative media 18', 18" as it passes over the media 18', 18" on its way back through the displacer 12, thereby cooling the media 18', 18". The reduced pressure within the shell 20 may lead to the release of some of the contaminant vapor adsorbed on the adsorbent 48. Since the gas is now flowing away from the cold end 34 of the shell 20, released contaminants are likely to flow out of the refrigerator and into the return line 38 rather than into the cold end 44 of the displacer 12 where they are likely to condense.

Once adsorbed, contaminant gases will not always remain adsorbed. Rather, there exists a fairly stable flux of molecules interchangeably adsorbing onto, releasing from and readsorbing onto the adsorbent 48. As the amount of contaminant gas adsorbed onto the adsorbent 48 increases, a slow migration of released contaminants toward the cold end 44 of the displacer 12 can be expected. Moreover, the adsorbent 48 may become saturated with adsorbed contaminants over time, thereby limiting its ability to capture additional contaminants. As a result, the risk of contaminant condensation and eventual clogging of passageways near the cold end 44 of the displacer 12 is not entirely eliminated. However, the rate at which contaminants migrate toward the cold end 44 of the displacer 12 can be greatly impeded by using an adsorbent 48, as disclosed above, to adsorb the contaminants at relatively warm temperatures.

Under a typical set of normal operating conditions, the cryogenic refrigerator illustrated in FIG. 2 processes helium gas compressed to 300 psig and expanded to 100 psig, with a full-cycle displacer reciprocation rate of 50–200 cycles per minute. As a component of an operating cryopump, the cold end 44 of the displacer 12 will cool to near 10K, and the adsorbent 48 is advantageously placed near the end cap 68 of the first stage 14 of the displacer 12 to adsorb nitrogen before it condenses.

Figure 3:
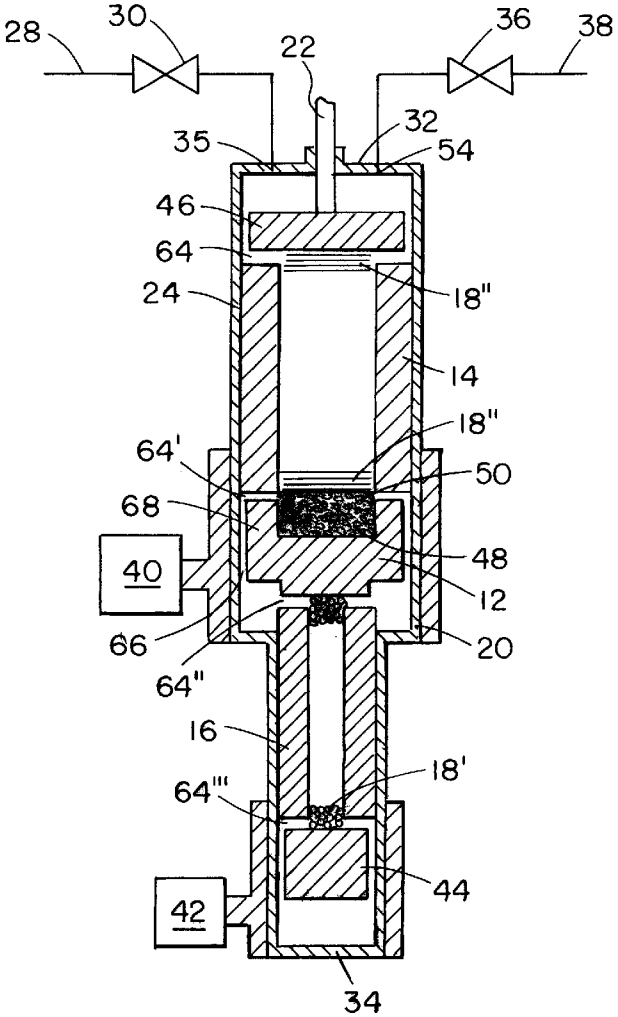
FIG. 3 is an illustration, partially schematic, of a cross-section of another cryogenic refrigerator of this invention, in which an adsorbent is positioned in a hollowed-out volume defined by the end cap.

An alternative embodiment of a cryogenic refrigerator of this invention is illustrated in FIG. 3. Whereas in conventional displacers, the end cap is solid, the end cap 68 in the illustrated embodiment is hollowed out to extend the chamber defined by the first stage 14 beyond the passage 64' toward the second stage 16. Although the area occupied by the adsorbent 48 is not in the direct flow path between the helium inlet 35 and the outlet passage 64', a sufficient amount of the compressed gas flow will circulate through this region to remove a substantial amount of contaminant gas. Because the adsorbent 48 is placed in newly-available volume within the end cap 68, the adsorbent 48 does not rob any of the typically-available space within the displacer from the regenerative media 18', 18". Because the volume within the displacer 12 is expanded into the end cap 68, the refrigerator's demand for compressed helium will increase slightly, however.

In another embodiment, the adsorbent 48 extends above the outlet passage 64' in the first stage 14 of the refrigerator illustrated in FIG. 3 so that the adsorbent 48 is positioned in the direct flow path of the compressed gas. In yet another embodiment, the adsorbent 48 is placed in the second stage 16, preferably at the warm end of the second stage 16 near passage 64".

Figure 4:
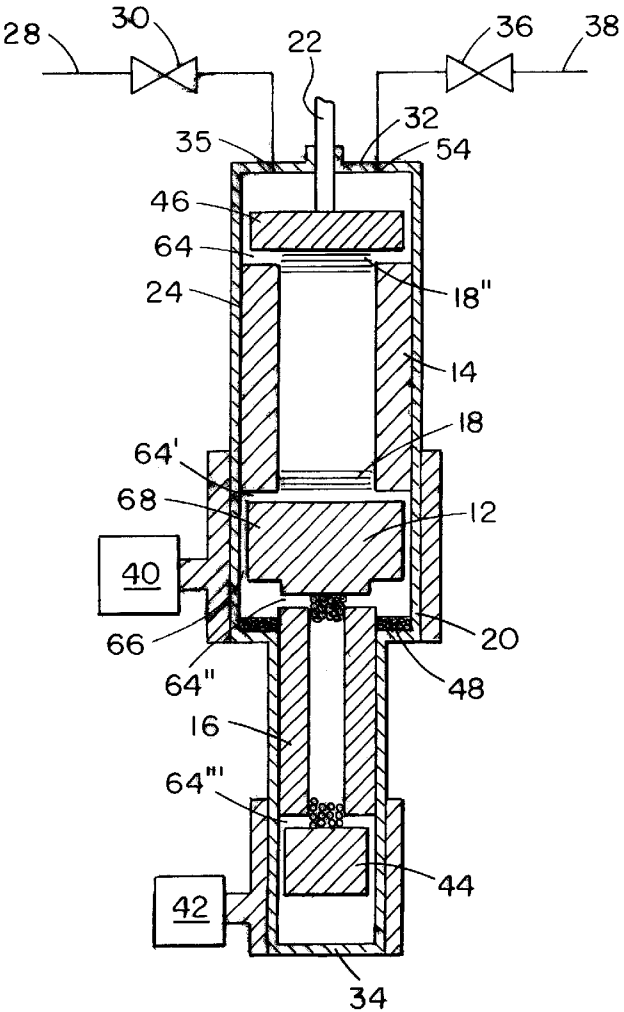
FIG. 4 is an illustration, partially scematic, of a cryogenic refrigerator of this invention, in which an adsorbent is positioned outside the displacer.

In yet another embodiment, illustrated in FIG. 4, the adsorbent 48 is positioned outside the displacer 12 at the cooler end of the first-stage cylinder 24 of the shell 20. In this embodiment, the adsorbent 48 is stationed at a fixed position where its temperature will be approximately that of the first-stage heat sink 40 and where it will be in contact with gas flowing through the refrigerator to adsorb contaminants therefrom.

Figure 5:
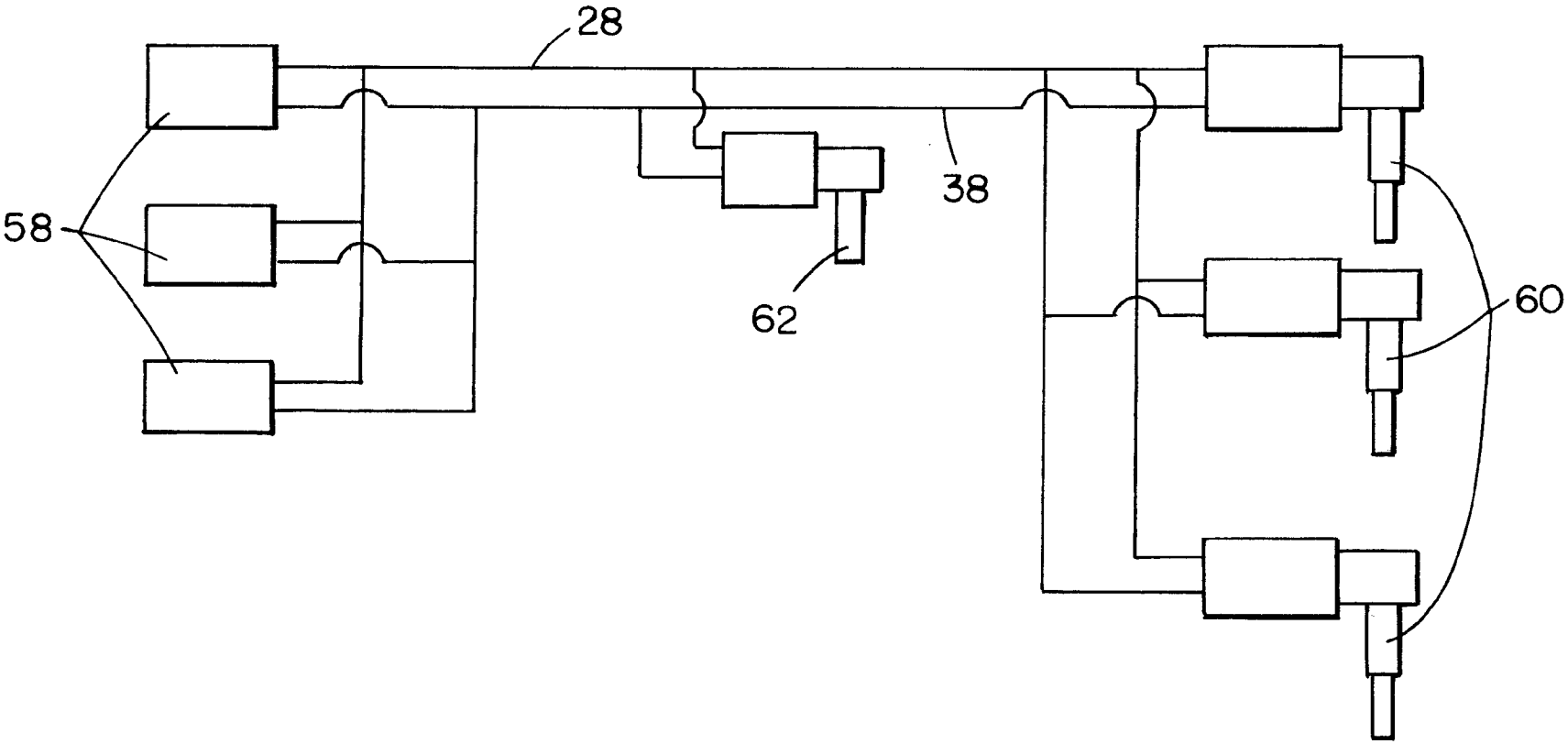
FIG. 5 is a schematic illustration of a cryogenic refrigeration system including multiple system refrigerators and a filtering refrigerator inserted into the helium circuit to remove contaminants from the system.

Another aspect of this invention is shown in FIG. 5, which illustrates a multi-refrigerator refrigeration system. Compressors 58 are connected in parallel to a supply line 28 and a return line 38. At an opposite end of the supply line 28 and return line 38, system cryogenic refrigerators 60 are connected in parallel, allowing each cryogenic refrigerator 60 to draw compressed gas from the common bank of compressors 58. Alternatively, a single compressor can be substituted for the bank of compressors 58. Such an apparatus of single or multiple compressors 58 and multiple cryogenic refrigerators 60 is commonly employed in cluster tools used for semiconductor fabrication. A cluster tool typically includes at least a pair of load locks, a transfer chamber, and a plurality of process chambers—each of which often requires its own cryopump. Within each of these cryopumps is a cryogenic refrigerator.

The design of such a system often necessitates an extensive array of supply and return lines 28, 38 for circulating the helium gas throughout the system. The length and complexity of these lines 28, 38 increase the difficulty of completely flushing the system of contaminants at the start of operation and also increase the opportunity for contaminants to infiltrate the helium circuit after operation has commenced. Of course, contaminants within the helium circuit will tend to condense out at the coldest regions of the circuit for the reasons described above. Accordingly contaminant condensate will aggregate at the cold end of each of the cryogenic refrigerators 60, thereby clogging helium flow and leading to ratcheting in the refrigerators 60.

In addition to or instead of providing adsorbent in individual refrigerators, a filtering refrigerator 62 may be inserted into the system to remove the contaminants. In this embodiment, the filtering refrigerator 62 is a single-stage cryogenic refrigerator with a single-stage displacer. Accordingly, the displacer will resemble the first stage of the displacer shown in FIG. 2, with the adsorbent positioned at or near the cold end of the displacer. During normal operation, the cold end of the displacer typically will reach a temperature of 40K. Alternatively, a two-stage refrigerator, such as any of those illustrated in FIGS. 2, 3 and 4, can serve as the filtering refrigerator 62.

If a contaminated system is shut down and allowed to warm, contaminants condensed within the system refrigerators 60 will be released. With the contaminants re-vaporized, the filtering refrigerator 62 is inserted into the helium circuit by connecting the inlet of the filtering refrigerator 62 to an inlet valve on the supply line 28 and the outlet of the filtering refrigerator 62 to an outlet valve on the return line 38 and then opening the valves. With the compressors 58 operating and with the valves of the system refrigerators 60 open, operation of the filtering refrigerator 62 commences. Cooldown of the filtering refrigerator 62 requires about 1.5 hours. As the filtering refrigerator 62 is the only cold component in the system, contaminants will selectively adsorb on the charcoal in the filtering refrigerator 62. For example, once cooled down, the filtering refrigerator 62 will typically remove most of the nitrogen from the system within another ½ hour. After the filtering refrigerator 62 has removed a desired amount of nitrogen, the inlet and outlet valves are closed, thereby isolating the filtering refrigerator 62 from the helium circuit. Once isolated, the filtering refrigerator 62 is allowed to warm, thereby releasing the contaminants, which are collected from it and removed.

After the filtering refrigerator 62 has completed its adsorption of contaminants or as it approaches completion of contaminant adsorption, operation of the system refrigerators 60 commences, thereby resuming normal operation using the newly-filtered helium gas supply flowing through the cleaned passages within the displacers.

The filtering refrigerator can also be used to remove contaminants released from any of the system refrigerators when it is warmed (for example, during regeneration) and contaminants condensed therein are released into the helium gas stream.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A cryogenic refrigerator, comprising:

a shell;

a displacer mounted for reciprocative displacement within the shell, wherein the displacer has a warm end and a cold end;

an adsorbent within the displacer; and regenerative media contained within the displacer, the regenerative media being distinct from the adsorbent and being positioned both between the cold end of the displacer and the adsorbent and between the warm end of the displacer and the adsorbent, the adsorbent being positioned out of the direct flow path of gas through the regenerative media.

2. The cryogenic refrigerator of claim 1, wherein the shell includes an inlet and an outlet, both of which are remote from the cold end of the displacer.

3. The cryogenic refrigerator of claim 1, wherein the adsorbent has a surface-to-volume ratio greater than 50 square meters per cubic centimeter.

4. The cryogenic refrigerator of claim 3, wherein the adsorbent has a mean pore size no more than 10 times its molecule size.

5. The cryogenic refrigerator of claim 1, wherein the adsorbent is selected from the group consisting of carbon, crystalline aluminosilicates, crystalline aluminophosphates and silica gel.

6. The cryogenic refrigerator of claim 5, wherein the adsorbent is charcoal.

7. The cryogenic refrigerator of claim 1, wherein the regenerative media is metal.

8. The cryogenic refrigerator of claim 1, wherein the displacer includes a first stage and a second stage, wherein the adsorbent is in the first stage, which operates at a temperature warmer than that of the second stage.

9. The cryogenic refrigerator of claim 8, wherein:

the displacer is mounted for reciprocative displacement along a longitudinal axis within the shell;

the first stage includes an end cap proximate to the second stage and a sidewall defining a side passage through which helium can flow during refrigerator operation;

the side passage intersects an imaginary plane normal to the longitudinal axis; and the adsorbent is contained within the first stage between the imaginary plane and the end cap.

10. The cryogenic refrigerator of claim 9, wherein the adsorbent is at a position in the displacer that has a temperature above 50K during normal operation of the cryogenic refrigerator.

11. The cryogenic refrigerator of claim 10 wherein the adsorbent is at a position in the displacer that has a temperature below 150K during normal operation of the cryogenic refrigerator.

12. A cryogenic refrigerator, comprising:

a shell;

a reciprocative displacer within the shell;

an adsorbent in a region within the shell that has a temperature above about 50K during normal operation of the cryogenic refrigerator; and regenerative media distinct from the adsorbent, the adsorbent being positioned out of the direct flow path of gas through the regenerative media.

13. The cryogenic refrigerator of claim 12, wherein the adsorbent is within the displacer.

14. The cryogenic refrigerator of claim 13, wherein the adsorbent is in a region within the displacer that has a temperature below about 150K during normal operation of the cryogenic refrigerator.

15. The cryogenic refrigerator of claim 14, wherein the adsorbent is positioned exclusively in regions of the displacer having temperatures greater than about 40K during normal operation of the cryogenic refrigerator.

16. The cryogenic refrigerator of claim 14, wherein the adsorbent is selected from the group consisting of carbon, crystalline aluminosilicates, crystalline aluminophosphates and silica gel.

17. The cryogenic refrigerator of claim 16, wherein the adsorbent is charcoal.

18. The cryogenic refrigerator of claim 14, wherein the regenerative media is metal.

19. The cryogenic refrigerator of claim 14, wherein:

the displacer includes a first stage and a second stage and is mounted for reciprocative displacement along a longitudinal axis within the shell;

the first stage includes an end cap proximate to the second stage and a sidewall defining a side passage through which helium can flow during refrigerator operation;

the side passage intersects an imaginary plane normal to the longitudinal axis; and the adsorbent is contained within the first stage between the imaginary plane and the end cap.

20. The cryogenic refrigerator of claim 19, wherein regenerative media is contained within the first stage on a side of the imaginary plane opposite the adsorbent.

21. The cryogenic refrigerator of claim 12, wherein the adsorbent is positioned external to the displacer.

22. The cryogenic refrigerator of claim 21, wherein the adsorbent is in a region within the shell that has a temperature below about 150K during normal operation of the cryogenic refrigerator.

23. The cryogenic refrigerator of claim 22, wherein the adsorbent is positioned exclusively in regions of the shell having temperatures greater than about 40K during normal operation of the cryogenic refrigerator.

24. A cryogenic refrigerator comprising:

regenerative media contained within a chamber through which gas flows to a cold end of the refrigerator; and adsorbent positioned adjacent to but out of the direct flow path of gas through the regenerative media and exposed to the gas.

* * * * *